US007059232B2

(12) United States Patent
Kowal

(10) Patent No.: US 7,059,232 B2
(45) **Date of Patent: *Jun. 13, 2006**

(54) METHOD OF FORMING BRIDGES IN TAMPER-INDICATING CLOSURES

(75) Inventor: Timothy B. Kowal, Maumee, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/910,391

(22) Filed: Aug. 3, 2004

(65) Prior Publication Data

US 2005/0005757 A1 Jan. 13, 2005

Related U.S. Application Data

(60) Division of application No. 09/649,546, filed on Aug. 28, 2000, now Pat. No. 6,817,276, which is a division of application No. 09/227,422, filed on Jan. 8, 1999, now abandoned, which is a continuation of application No. 08/708,529, filed on Sep. 5, 1996, now abandoned, which is a continuation of application No. 08/367,511, filed on Dec. 30, 1994, now Pat. No. 5,564,319, which is a division of application No. 08/048,638, filed on Apr. 19, 1993, now Pat. No. 5,488,888.

(51) Int. Cl.
*B26D 3/08* (2006.01)
*B26F 1/18* (2006.01)
*B65D 41/34* (2006.01)

(52) U.S. Cl. ..... 83/880; 83/49; 83/54; 83/881; 83/882; 83/946; 82/1.11; 82/47; 215/252; 264/154

(58) Field of Classification Search ..... 83/49, 83/54, 660, 678, 695, 856, 862–864, 879–884, 83/886, 887, 946, 679; 82/1.11, 46, 47, 53.1, 82/56, 82, 83, 85, 101; 215/252–254; 264/154; 413/10, 17, 67, 68; 425/290, 291, 809
See application file for complete search history.

(56) References Cited

U.S. PATENT DOCUMENTS

| | | | | |
|---|---|---|---|---|
| 2,361,288 | A * | 10/1944 | Hardy, Jr. | 83/679 X |
| 3,311,077 | A * | 3/1967 | Andrew et al. | 413/67 |
| 3,411,208 | A * | 11/1968 | Malm | 30/350 |
| 3,416,474 | A * | 12/1968 | Musy | 413/10 |
| 3,824,941 | A * | 7/1974 | Hannon | 413/10 |
| 3,988,953 | A | 11/1976 | Bosley et al. | |
| 4,322,009 | A | 3/1982 | Mumford | |

(Continued)

FOREIGN PATENT DOCUMENTS

| | | |
|---|---|---|
| DE | 2262231 | 7/1974 |

(Continued)

*Primary Examiner*—Clark F. Dexter

(57) ABSTRACT

A tamper indicating closure comprising a base wall and a peripheral skirt having an internal thread adapted to engage the threads of a container wherein a tamper indicating band is provided on the skirt by a plurality of circumferentially spaced bridges. The band includes portions adapted to engage an annular bead on the container. The bridges are formed by using a primary knife having an interrupted cutting edge to produce a circumferential score in the side wall of the closure leaving spaced connectors or bridges followed by using a secondary knife having a continuous cutting edge to provide a continuous external score line and an accurately dimensional radial thickness of the bridges. In a preferred method and apparatus, the closures engage the successive primary and secondary knives and are moved such that the closures roll relative to the knives.

22 Claims, 5 Drawing Sheets

U.S. PATENT DOCUMENTS

| | | | |
|---|---|---|---|
| 4,538,489 | A | 9/1985 | Takano |
| 4,545,496 | A | 10/1985 | Wilde et al. |
| 4,595,110 | A | 6/1986 | Herr |
| 4,613,052 | A | 9/1986 | Gregory et al. |
| 4,658,976 | A | 4/1987 | Pohlenz |
| 4,666,053 | A | 5/1987 | Corcoran et al. |
| 4,721,218 | A | 1/1988 | Gregory et al. |
| 4,744,480 | A | 5/1988 | Luch et al. |
| 4,801,031 | A | 1/1989 | Barriac |
| 4,805,792 | A | 2/1989 | Lecinski, Jr. |
| 4,934,227 | A | 6/1990 | Knorr |
| 4,967,920 | A | 11/1990 | Dahl |
| 5,090,788 | A | 2/1992 | Ingram et al. |
| 5,117,721 | A | 6/1992 | Montrose |
| 5,405,032 | A | 4/1995 | Anderson |
| 5,488,888 | A | 2/1996 | Kowal |
| 5,564,319 | A | 10/1996 | Kowal |

FOREIGN PATENT DOCUMENTS

| | | |
|---|---|---|
| EP | 0228618 | 7/1987 |
| EP | 0533633 | 3/1993 |
| FR | 2393736 | 1/1979 |
| JP | 2-23313 | 5/1990 |

* cited by examiner

FIG.5
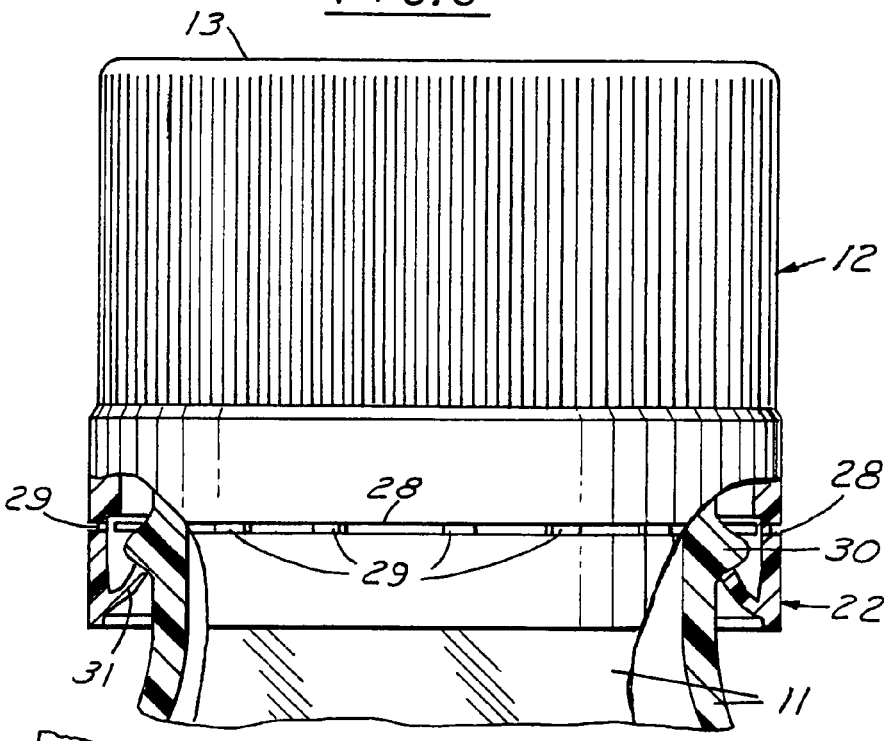
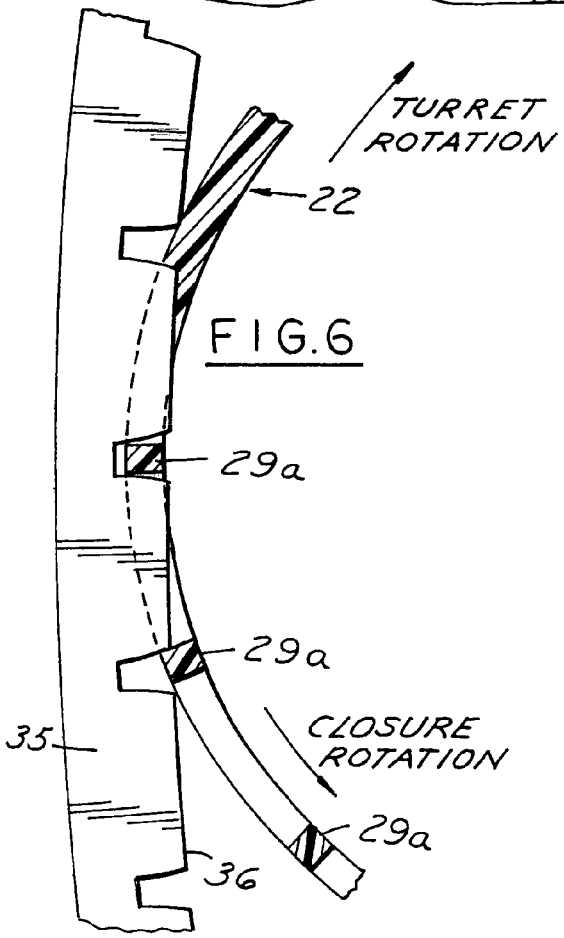
FIG.6
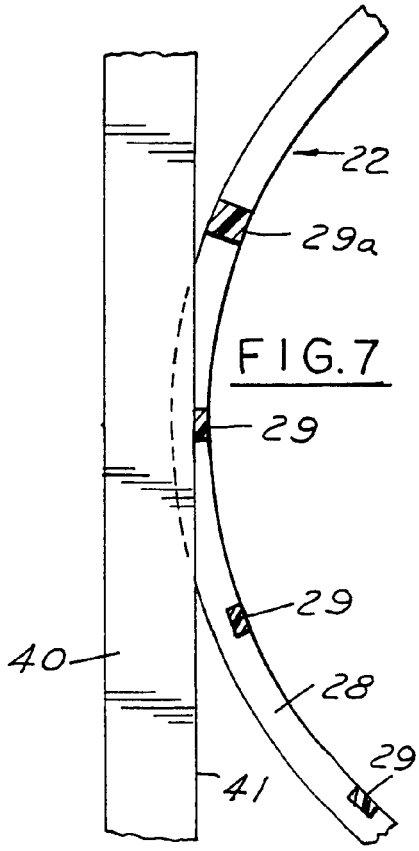
FIG.7

METHOD OF FORMING BRIDGES IN TAMPER-INDICATING CLOSURES

This application is a division of application Ser. No. 09/649,546 filed Aug. 28, 2000 now U.S. Pat. No. 6,871, 276, which is a division of application Ser. No. 09/227,422 filed Jan. 8, 1999 and now abandoned, which is a continuation of application Ser. No. 08/708,529 filed Sep. 5, 1996 and now abandoned, which is a continuation and division of application Ser. No. 08/367,511 filed Dec. 30, 1994 and now U.S. Pat. No. 5,564,319, which is a division of application Ser. No. 08/048,638 filed Apr. 19, 1993, and now U.S. Pat. No. 5,488,888.

This invention relates to tamper indicating closures.

BACKGROUND AND SUMMARY OF THE INVENTION

In one type of tamper-indicating closure, it is conventional to mold circumferentially spaced bridges in order to define a tamper-indicating band on the closure. Such construction requires costly more complex molds which also require maintenance. Typical patents showing such tamper indicating closures comprise U.S. Pat. Nos. 4,613,052, 4,721,218, 4,801,031, 5,090,246 and 5,090,788.

Another type of tamper-indicating closure comprises utilizing an interrupted edged knife to produce bridges such as shown in U.S. Pat. No. 4,322,009.

In another type of tamper-indicating closure, circumferentially spaced axial bridges are provided on the internal surface of the skirt of the closure and a continuous edged knife is applied from the exterior surface cutting through the w all of the closure and into the bridges. Such a construction also requires costly complex molds that require maintenance and necessitates relatively thin walls on the closures. A typical patent showing such a construction comprises U.S. Pat. No. 4,545,496.

Among the objectives of the present invention are to provide a tamper-indicating closure on a molded plastic closure which does not require molded bridges, which can be made by relatively simple less costly molds, wherein the precise configuration of the bridges can be adjusted as desired, and wherein the bridges can be made at relatively high speeds and the desired configuration and strength of the bridges can be maintained, and wherein an improved method and apparatus insure accurately dimensional bridges.

In accordance with the invention, a tamper-indicating closure comprises a base wall and a peripheral skirt having an internal thread adapted to engage the threads of a container wherein a tamper-indicating band is provided on the skirt by a plurality of circumferentially spaced bridges. The band includes portions adapted to engage an annular bead on the container. The bridges are formed by using a primary knife having an interrupted cutting edge to produce a circumferential score in the side wall of the closure leaving spaced connectors or bridges followed by using a secondary knife having a continuous cutting edge to provide a continuous external score line and an accurately dimensional radial thickness of the bridges. In a preferred method and apparatus, the closures engage the successive primary and secondary knives and are moved such that the closures roll relative to the knives.

DESCRIPTION OF THE DRAWINGS

FIG. 5 is a part sectional view of the closure and 10 container;

FIGS. 6 and 7 are partly diagrammatic views showing the steps in the formation of the bridges;

DESCRIPTION

Figure 1:
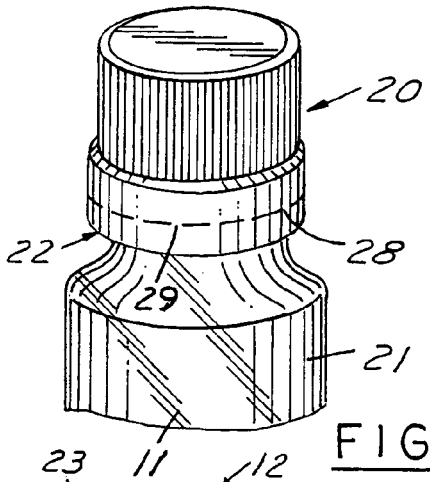
FIG. 1 is a fragmentary perspective view of a portion of a container embodying the invention.
Figure 2:
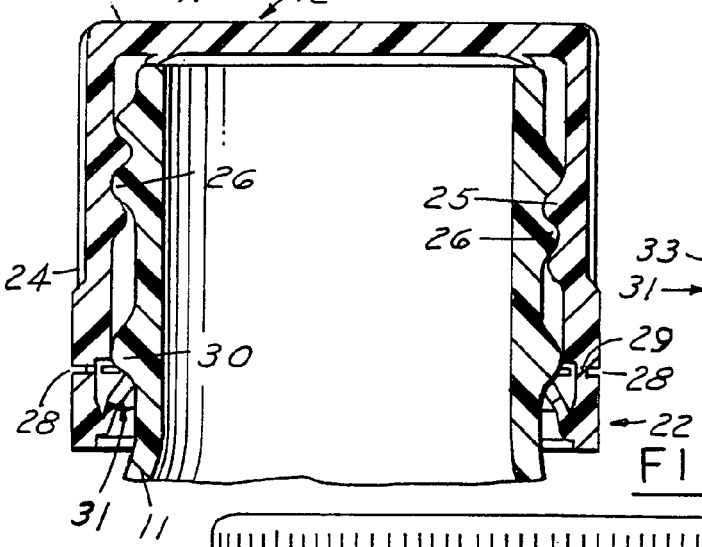
FIG. 2 is a fragmentary vertical sectional view through 5 the container enclosure embodying the invention.
Figure 4:
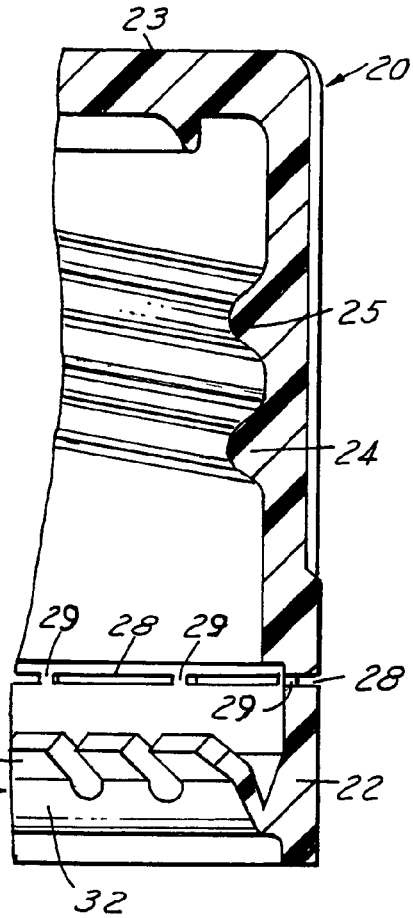
FIG. 4 is a fragmentary sectional view of a portion of the closure.
Figure 3:
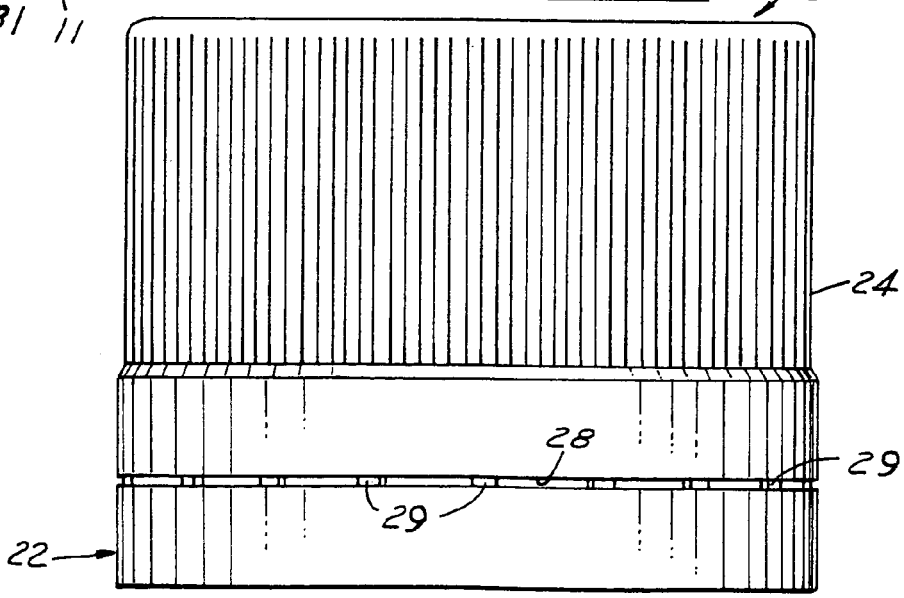
FIG. 3 is an elevational view of the closure.

Referring to FIGS. 1–5, the tamper-indicating closure 20 is adapted to be applied to a container 21 and has a tamper-indicating band 22. The closure 20 is made of plastic material such as polypropylene or polyethylene. The closure 20 includes a base wall 23 and peripheral skirt 24 having internal threads 25 adapted to engage external threads 26 on the container 21. A score line 28 extends radially inwardly and circumferentially of the lower portion of the skirt to form the tamper-indicating band 22 having circumferentially spaced bridges 29. The tamper-indicating band 22 includes interengaging means on the band which engages an annular bead or flange on the container to retain the closure on the container.

The interengaging means preferably comprises an annular flange 31 extending axially upwardly and inwardly from the tamper-indicating band toward the base wall of the closure and including a first continuous annular flange portion 32 connected to the band by a hinge portion and a second portion 33, the free edges of which engage beneath bead 30 on the container 21 when the closure 20 is threaded onto the container 21. Such a tamper-indicating closure in one form includes a plurality of segment portions and in another form includes a second continuous flange portion. The flange 31 in both forms is bent intermediate its ends so that the second portion 33 extends inwardly at a greater angle than the first continuous flange portion 32, all as shown in U.S. Pat. No. 5,090,788, incorporated herein by reference. Other types of tamper-indicating bands may also be used as is well known in the art.

The bridges 29 are formed on the closure by rotating the closure relative to a series of knives. As shown in FIG. 6, a primary knife 35 is provided and has an interrupted edge 36 so that when the closure is rolled relatively to the knife 35, a plurality of preformed bridges 29*a* are provided. The closure is then rotated past a secondary knife 40 that has a continuous edge 41 that extends inwardly of the score formed by the primary knife 35 and cuts the preformed bridges 29*a* to form rectangular bridges in cross section which have a greater circumferential width than radial thickness. The continuous knife 40 also accurately dimensions the radial thickness of the bridges 29 as shown in FIG. 7. The relative movement of the closure and knives 35, 40 is such that the closure is moved along the edges 36, 41 of the knives 35, 40 and is simultaneously rotated about its axis so that the rate of movement and peripheral rate of rotation are substantially the same.

Figure 8:
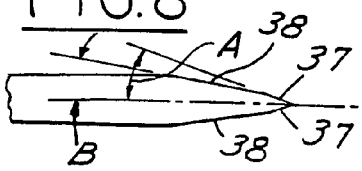
FIG. 8 is a fragmentary view of a portion of a primary knife utilized to form the bridge.
Figure 9:
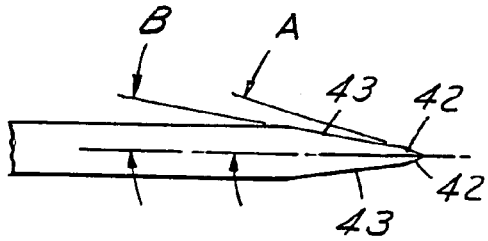
FIG. 9 is a fragmentary sectional view of a portion of a secondary knife for controlling the dimension of the bridges.

As shown in FIGS. 8 and 9, the knives 35, 40 preferably have their cutting edges 36, 41 formed with a cross section comprising a cutting edge that has tapered surfaces 37, 42 each of which forms an angle A with the central plane of the knife 35, 40 respectively and tapered surfaces 38, 43 outwardly of the knife edge forming a lesser angle B with the central plane of the knife 35, 40 respectively. In a typical example, knives 35, 40 have an axial thickness of 0.015 in., angle A=18° and angle B=9°.

Figure 10:
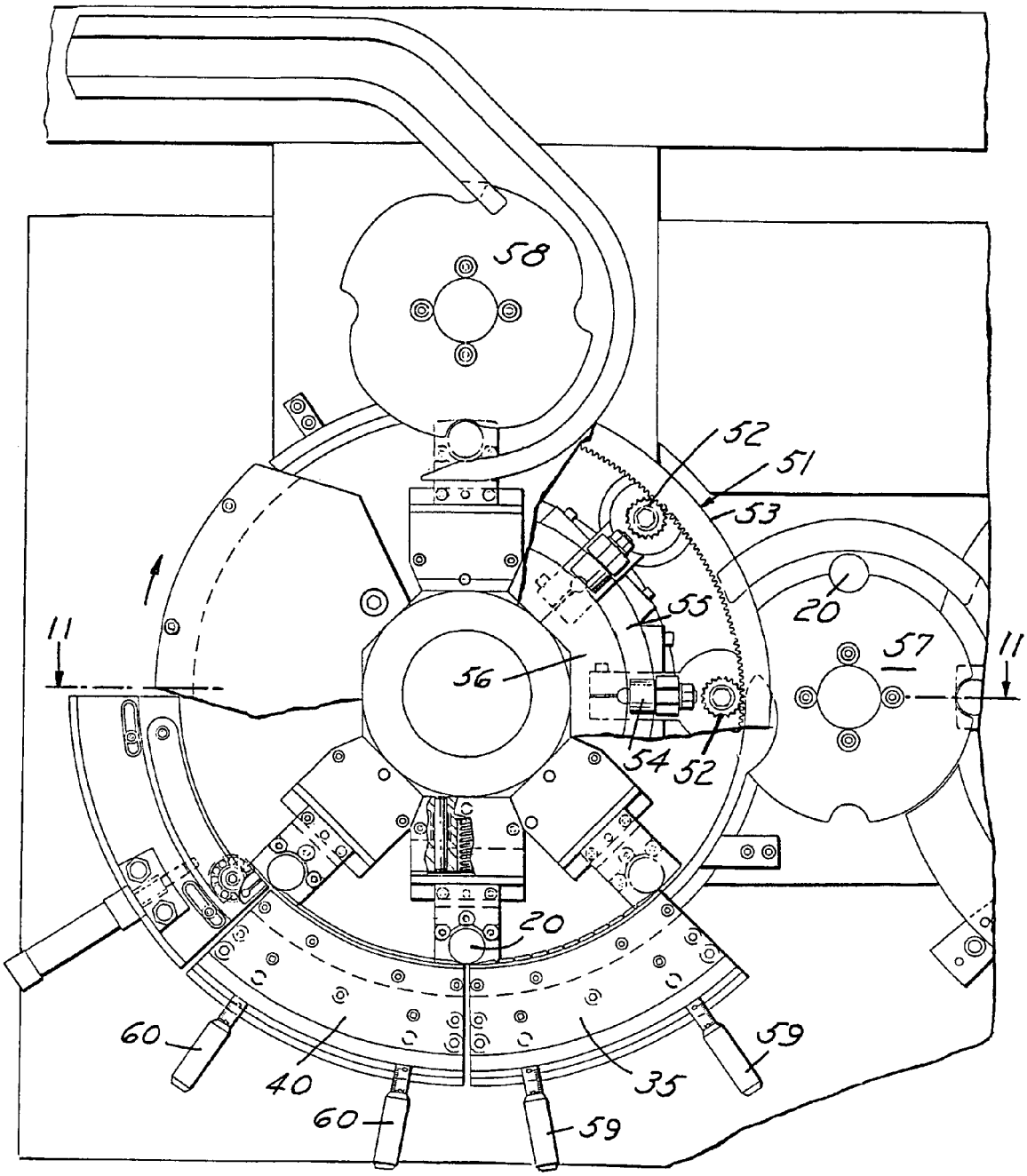
FIG. 10 is a plan view of an apparatus for forming the bridges.
Figure 11:
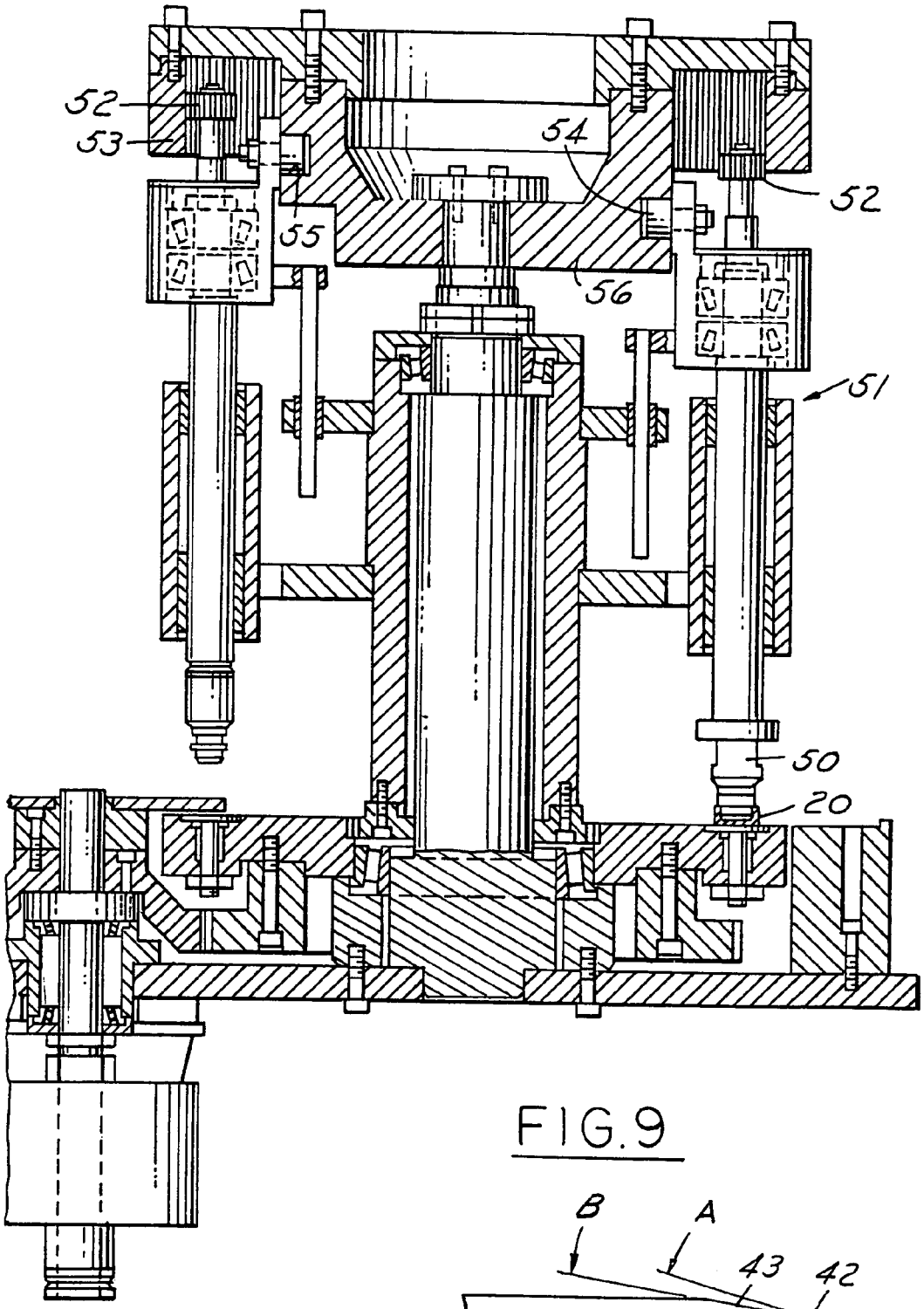
FIG. 11 is a fragmentary plan view of the apparatus taken along the line 11—11 in FIG. 10.

A typical apparatus for forming the closure is shown in FIGS. 10 and 11 and comprises a mandrel 50 on which the closure is mounted. The mandrel 50 is rotated as well as moved past the knives 35, 40 so that the primary knife 35 forms the preformed bridges 29*a* and the secondary knife 40 forms the final bridges 29.

Preferably, the mandrel 50 is one of a plurality of mandrels 50 on a turret 51 and the turret 51 is rotated while the mandrels are being rotated about their axes providing a true rolling action of the closure past the knives 35, 40.

As shown in FIGS. 10 and 11, the mandrels 50 are mounted for rotation and vertical movement on the rotating turret 51. A pinion gear 52 on the upper end of each mandrel 50 engages an annular fixed internal gear sector 53. The mandrels 50 are moved vertically into and out of engagement with the inverted closures by a cam follower 54 which follows an annular cam track 55 in a fixed cam above the turret 51.

As shown in FIG. 10, star wheels 57, 58 are provided for feeding and removing the closures 20 from the apparatus.

As further shown in FIG. 10, micrometer screws 59, 60 are provided for accurately positioning knives 35, 40 after which the mounting screws are tightened to lock the knives in adjusted position.

When the closures are moved in an annular path by the turret 51 with the knives 35, 40 positioned radially outwardly of the mandrels 50, the edges 36, 41 of the primary knife 35 and secondary knife 40 extend radially inwardly and are curved in a concave arc parallel to the path of travel of the mandrels 50.

Figure 12:
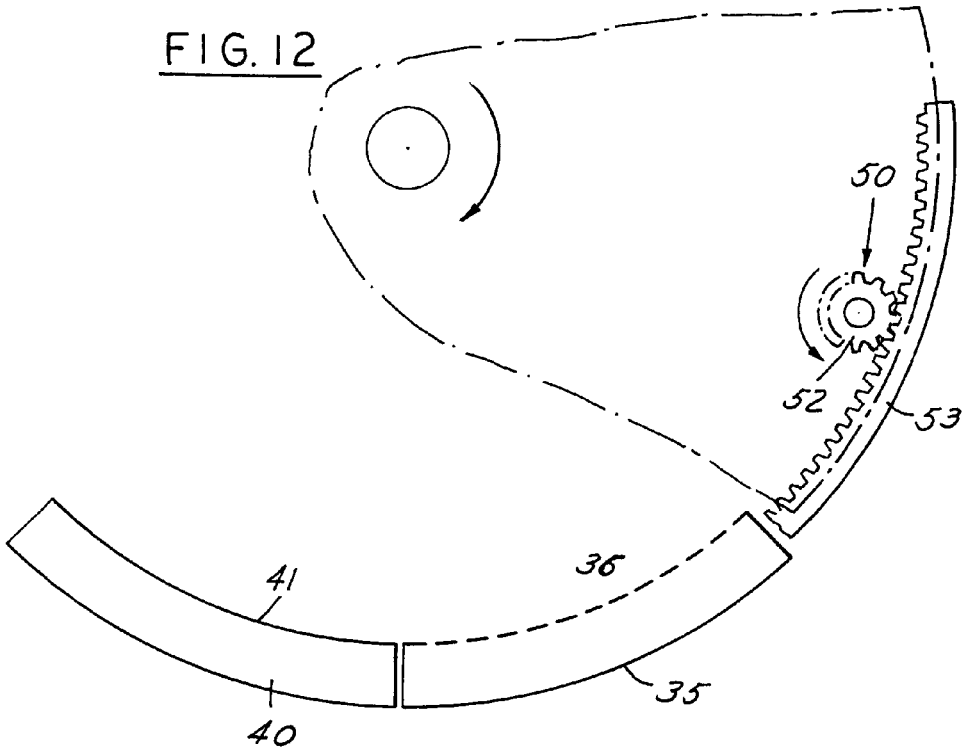
FIG. 12 is a diagram of the relative movements of the closure and knives.

As shown in the diagram, FIG. 12, in this arrangement, the turret 51 is rotating clockwise, as viewed from above, moving the mandrels 50 in a clockwise direction. As the mandrels 50 approach the knives 35, 40 the mandrels 50, and in turn the closures thereon, are rotated counterclockwise by engagement of the pinion gear 52 with the fixed internal gear 53. This provides the desired movement of the closures along the knives 35, 40 and the desired rolling action of the closures relative to the knives 35, 40.

Figure 13:
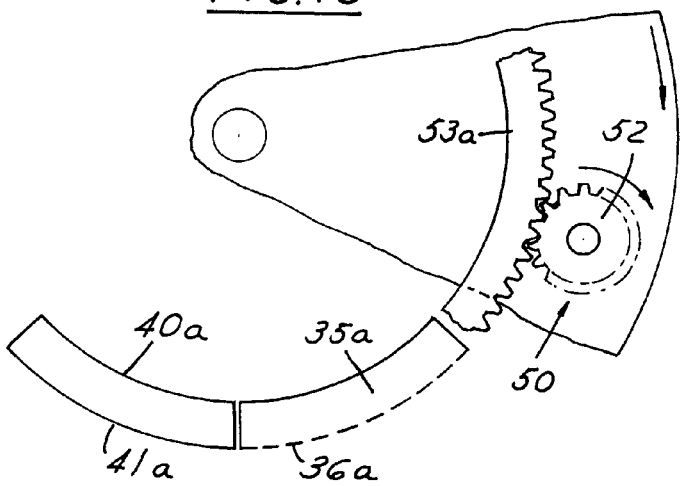
FIG. 13 is a diagram of the relative movements of the closure and knives of a modified method and apparatus.

Referring to the diagram shown in FIG. 13, if the knives 35*a*, 40*a* are positioned radially inwardly of the mandrels 50, the knives 35*a*, 40*a* have edges 36*a*, 41*a* which extend radially outwardly and are reversed relative to FIG. 12. In addition, a fixed gear sector 53*a* having external teeth is positioned radially inwardly for engagement with the pinion gear 52. As a result, the mandrels 50 are rotated clockwise as well as revolved clockwise to obtain the desired movement of the closures along the knives 35*a*, 40*a* and the desired rolling action of the closures relative to the knives 35*a*, 40*a*.

Figure 14:
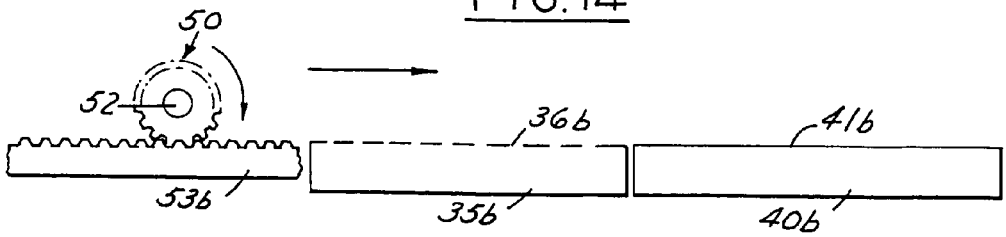
FIG. 14 is a diagram of the relative movements of the closure and knives of a further modified method and apparatus.

Referring to FIG. 14, if the mandrels 50 are moved in an endless path which has a straight portion along which the knives are successively positioned, the knives 35*b*, 40*b* have straight edges 36*b*, 41*b*. The gear sector is a straight fixed rack gear 53*b* that has teeth which engage the pinion gear 52 on the mandrels. As a result, the mandrels 50 are moved in a straight line past the successive knives 35*b*, 40*b* and the mandrels 50 are rotated clockwise to obtain the desired rolling action relative to the knives 35*b*, 40*b*.

It can thus be seen that there has been provided a tamper-indicating closure on a molded plastic closure which does not require molded bridges, which can be made by relatively simple less costly molds, wherein the precise configuration of the bridges can be adjusted as desired, and wherein the bridges can be made at relatively high speeds and the desired configuration and strength of the bridges can be maintained, and wherein an improved method and apparatus insure accurately dimensional bridges.

The invention claimed is:

1. A method of forming a tamper indicating closure from a plastic closure having a base wall and a peripheral skirt, which includes the steps of:

(a) providing a primary cutting knife having an interrupted cutting edge for cutting an interrupted circumferential score, said interrupted circumferential score including circumferentially spaced cuts and a plurality of bridges respectively separating said spaced cuts, said interrupted cutting edge of said primary knife having a cross section with opposed tapered surfaces forming opposite identical angles relative to a plane through the center of said primary cutting knife and intersecting the cutting edge of said knife, (b) supporting said primary cutting knife in a fixed position on a first support for cutting at a first depth into said peripheral skirt, (c) providing a secondary cutting knife having a continuous cutting edge for cutting a circumferential score, said continuous cutting edge of said secondary knife having a cross section with opposed tapered surfaces forming opposite identical angles relative to a plane through the center of said secondary cutting knife and intersecting the cutting edge of said secondary cutting knife, both said primary cutting knife and said secondary cutting knife having said tapered surfaces adjacent to said cutting edges forming an angle A with the central plane of each knife, and both said tapered surfaces spaced from said cutting edges forming an angle B, less than said angle A, with the central plane of each knife, (d) supporting said secondary cuffing knife in a fixed position on a second support for cuffing a second depth into said peripheral skirt, said second support positioning said secondary cuffing knife such that said continuous cuffing edge is aligned with said interrupted circumferential score, (e) variably positioning said primary cuffing knife on said first support, and variably positioning said secondary cutting knife on said second support independent of said primary cuffing knife and said first support, and (f) moving said plastic closure successively past said primary cuffing knife and said secondary cuffing knife initially to bring the peripheral skirt of said plastic closure into contact with said interrupted cuffing edge of said primary cuffing knife to cut said interrupted circumferential score having said plurality of circumferentially spaced bridges, and thereafter to bring said peripheral skirt of said plastic closure into contact with said continuous cutting edge of said secondary cutting knife to cut in and along said interrupted circumferential score to dimension accurately the radial thickness of said bridges.

2. The method set forth in claim 1 wherein said step (f) includes the step of rotating said plastic closure as it is moved past said primary cuffing knife and said secondary cuffing knife.

3. The method set forth in claim 2 wherein said step (f) includes moving said plastic closure in a straight path, and wherein said primary cuffing knife and said secondary cuffing knife have straight cutting edges.

4. The method set forth in claim 3 wherein said step (f) includes moving a plurality of said plastic closures by operation of a plurality of mandrels, each mandrel engaging one of said plastic closures for moving each of said plastic closures past the knives.

5. The method set forth in claim 4 wherein said step of rotating said plastic closure is carried out by a pinion gear on each mandrel and a straight fixed rack gear engaging said pinion gear.

6. The method set forth in claim 1 wherein said step (b) includes moving said plastic closure in an arcuate path, and wherein said primary cuffing knife and said secondary cuffing knife have arcuate cuffing edges which conform to said path.

7. The method set forth in claim 6 wherein said step (f) includes moving a plurality of said plastic closures by operation of a turret, having a plurality of mandrels mounted on said turret for movement in a closed path, each mandrel engaging one of said plastic closures and moving each of said plastic closures successively past said primary cuffing knife and said secondary cutting knife.

8. The apparatus set forth in claim 7 wherein said step (f) includes the step of rotating each mandrel as it moves said plastic closures past said primary cuffing knife and said secondary cuffing knife.

9. The method set forth in claim 8 wherein said primary cuffing knife and said secondary cuffing knife are positioned radially outwardly of said path of the mandrels and wherein said knives have concave cuffing edges.

10. The method set forth in claim 9 wherein said step of rotating each mandrel is carried out by a pinion gear on each said mandrel and a gear having internal teeth engaged by said pinion gear such that, when the turret is moved in one direction to move the mandrels and the plastic closures thereon past said knives, the mandrels and the plastic closures are rotated in an opposite direction such that the plastic closures roll relative to said knives.

11. The method set forth in claim 8 wherein said primary cutting knife and said secondary cutting knife are positioned radially inwardly of said path of said mandrels and wherein said knives have convex cutting edges.

12. The method set forth in claim 11 wherein said step of rotating each mandrel is carried out by a pinion gear on each said mandrel and a gear having external teeth engaged by said pinion gear such that, when the turret is moved in one direction to move the mandrels and the plastic closures thereon past said knives, the mandrels and the plastic closures are rotated in the same direction such that the plastic closures roll relative to said knives.

13. The method set forth in claim 1 wherein said angle A is 18° and said angle B is 9°.

14. A method of forming a tamper indicating closure from a plastic closure having a base wall and a peripheral skirt, which includes:

providing a primary arcuate cutting knife having a center of curvature and an interrupted cutting edge for cutting an interrupted circumferential score, said interrupted circumferential score including circumferentially spaced cuts and a plurality of bridges respectively separating said spaced cuts, said interrupted cutting edge of said primary cutting knife having cutting edges formed with a cross section having opposed tapered surfaces each forming an angle relative to a radian through the center of curvature of said arcuate cutting knife and intersecting the cutting edge of said knife, supporting said primary cutting knife in a fixed position for cutting at a first depth into said peripheral skirt, providing a secondary arcuate cutting knife having a center of curvature and a continuous cutting edge for cutting a circumferential score, supporting said secondary cutting knife in a fixed position for cutting at a second depth into said peripheral skirt, and positioning said secondary cutting knife such that said continuous cutting edge is aligned with said interrupted circumferential score, and each said primary knife and secondary knife having opposite tapered surfaces, said tapered surfaces adjacent said cutting edge forming an angle A relative to a radian through the center of curvature of said knife and intersecting the cutting edge of said knife, and said tapered surfaces spaced from said cutting edge forming an angle B, less than the angle A, with the central plane of each knife relative to a radian through the center of curvature of said knife and intersecting the cutting edge of said knife, providing first adjustment means for variably positioning said primary cutting knife on said first support means, and providing second adjustment means for variably positioning said secondary cutting knife on second support means independent of said first adjustment means on said first support means, moving said plastic closure successively past said primary cutting knife and said secondary cutting knife to initially bring the peripheral skirt of said plastic closure into contact with said interrupted cutting edge of said primary cutting knife to cut said interrupted circumferential score having said plurality of circumferentially spaced bridges, and to thereafter bring said peripheral skirt of said plastic closure into contact with said continuous cutting edge of said secondary cutting knife to cut in and along said interrupted circumferential score to accurately dimension the radial thickness of said bridges.

15. The method set forth in claim 14 wherein moving said plastic closure includes rotating said plastic closure as it is moved past said primary cutting knife and secondary cutting knife.

16. The method set forth in claim 14 wherein said moving said plastic closure comprises moving said plastic closure in an arcuate path and providing said primary cutting knife and said secondary cutting knife with arcuate cutting edges which conform to said path.

17. The method set forth in claim 16 wherein moving said plastic closure comprises moving a plurality of said plastic closures and comprises providing a turret, and providing a plurality of mandrels mounted for movement in a closed path, each mandrel being adapted to engage one of said plastic closures for moving each of said plastic closures successively past said primary cutting knife and said secondary cutting knife.

18. The method set forth in claim 17 wherein moving said plastic closure includes rotating each mandrel as it moves said plastic closures past said primary cutting knife and said secondary cutting knife.

19. The method set forth in claim 18 including positioning said primary cutting knife and said second cutting knife radially outwardly of said path of the mandrels and providing said knives with concave cutting edges.

20. The method set forth in claim 19 wherein rotating each mandrel comprises providing a pin ion gear on each said mandrel and a gear having internal teeth engaged by said pinion gear such that when the turret is moved in one direction to move the mandrels and the plastic closures thereon past said knives, the mandrels and the plastic closures are rotated in an opposite direction such that the plastic closures roll relative to said knives.

21. The method set forth in claim 18 including positioning said primary cutting knife and said second cutting knife radially inwardly of said path of said mandrels and providing said knives with convex cutting edges.

22. The method set forth in claim 21 wherein rotating each mandrel comprises providing a pinion gear on each said mandrel and a gear having external teeth engaged by said pinion gear such that when the turret is moved in one direction to move the mandrels and in the plastic closures thereon past said knives, the mandrels and the plastic closures are rotated in the same direction such that the plastic closures roll relative to said knives.

* * * * *